US005496158A

United States Patent [19]

Barito et al.

[11] Patent Number: 5,496,158

[45] Date of Patent: Mar. 5, 1996

[54] DRIVE FOR SCROLL COMPRESSOR

[75] Inventors: Thomas R. Barito, East Syracuse; Cheryl M. Keiling, Syracuse, both of N.Y.

[73] Assignee: Carrier Corporation, Syracuse, N.Y.

[21] Appl. No.: 361,399

[22] Filed: Dec. 22, 1994

[51] Int. Cl.[6] ..... F04C 18/04; G05G 1/00

[52] U.S. Cl. ..... 418/55.5; 418/57; 74/570; 74/571 R; 74/571 L

[58] Field of Search ..... 418/14, 55.1, 55.5, 418/57; 74/570, 571 R, 571 L

[56] References Cited

U.S. PATENT DOCUMENTS

| | | | |
|---|---|---|---|
| 4,650,405 | 3/1987 | Iwanami et al. | 418/55.1 |
| 4,808,094 | 2/1989 | Sugimoto et al. | 418/55.5 |
| 5,017,107 | 5/1991 | Fraser, Jr. et al. | 418/55.5 |
| 5,085,565 | 2/1992 | Barito | 418/55.5 |
| 5,090,878 | 2/1992 | Haller | 418/55.5 |
| 5,111,712 | 5/1992 | Kassouf et al. | 74/570 |
| 5,197,868 | 3/1993 | Caillat et al. | 418/57 |
| 5,222,881 | 6/1993 | Sano et al. | 418/55.1 |
| 5,320,507 | 6/1994 | Monnier et al. | 418/55.6 |
| 5,378,129 | 1/1995 | Dunaevsky et al. | 418/55.5 |

*Primary Examiner*—John J. Vrablik

[57] ABSTRACT

Rolling element bearings are located between the eccentric drive pin and the slider block of a scroll compressor. The rolling elements reduce static or boundary lubrication friction by an order of magnitude in providing rolling friction. As a result, movement of the orbiting scroll into and out of flank contact is facilitated and scroll separation takes place earlier in the shutdown process.

20 Claims, 5 Drawing Sheets

DRIVE FOR SCROLL COMPRESSOR

BACKGROUND OF THE INVENTION

In some scroll compressors the crankshaft is supported at one end and near the other end such that an eccentric drive pin is overhung or cantilevered with respect to the bearing support. The drive pin coacts with the orbiting scroll of the compressor through a slider block or bushing which permits the drive pin to rotate while the orbiting scroll is held to an orbiting motion through an anti-rotation mechanism such as an Oldham coupling. The coaction between the drive pin and slider block is complicated by the nature of the force transmission. Centrifugal force tends to move the orbiting scroll radially outward against the radial gas forces exerted by the gas being compressed. This movement has the slider block sliding relative to the drive pin. At shutdown where the radial gas forces exceed the centrifugal force or in the case of liquid slugging, the orbiting scroll moves radially inward, again with sliding movement between the slider block and drive pin. Minor excursions can also take place due to irregularities in the flanks of the scroll wraps. Additionally, relative movement between the slider block and drive pin can result from deflection of the pin under load.

SUMMARY OF THE INVENTION

During shutdown, static friction acts with the diminishing centrifugal force to oppose the radial gas forces which tend to separate the wraps of the fixed and orbiting scroll. By reducing the static or boundary lubrication friction which is an order of magnitude greater than rolling friction, the radial gas forces will be able to overcome the centrifugal force and separate the scrolls earlier in the shutdown process. Separation of the scrolls permits a pressure equalization of the refrigeration or air conditioning system across the compressor. So, the inertia of the motion producing the centrifugal force will still temporarily oppose reverse operation of the compressor as the pressure differential across the compressor is reduced due to the separation of the wraps. When the compressor comes to a stop, the reduced pressure differential corresponds to a reduction in the motive power for reverse operation and will result in a less energetic reverse operation, at the minimum. The reduction/elimination of the tendency for reverse operation can permit the elimination of the check valve in the discharge line. Also, the providing of a more compliant link reduces the noise associated with scroll wrap impacts during steady state operation.

It is an object of this invention to radially separate the scroll flanks at shutdown.

It is an additional object of this invention to reduce the forces necessary to separate the wraps at shutdown.

It is another object of this invention to reduce or eliminate the tendency for reverse operation at shutdown.

It is a further object of this invention to provide a more compliant link.

These objects, and others as will become apparent hereinafter, are accomplished by the present invention.

Basically, rolling element bearings are mounted at the interface between the driving surface of the shaft and the driven surface of the slider block to minimize friction. Reduced friction permits separation of the wraps at shutdown prior to reversal.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
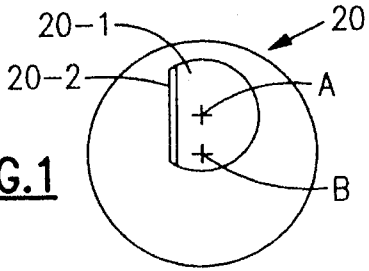
FIG. 1 is an end view of a crankshaft for use in a scroll compressor and employing the present invention.

In FIG. 1, the numeral 20 generally designates a crankshaft. Crankshaft 20 has an eccentrically located drive pin 20-1 having curved portion 20-2. The point A represents the axis of the drive pin 20-1 while the point B represents the axis of the crankshaft 20.

Figure 3:
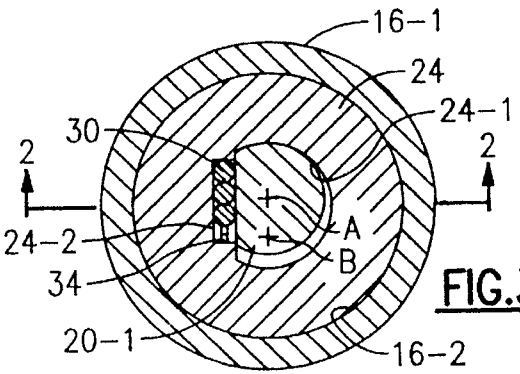
FIG. 3 is a sectional view taken along line 3—3 of FIG. 2.
Figure 2:
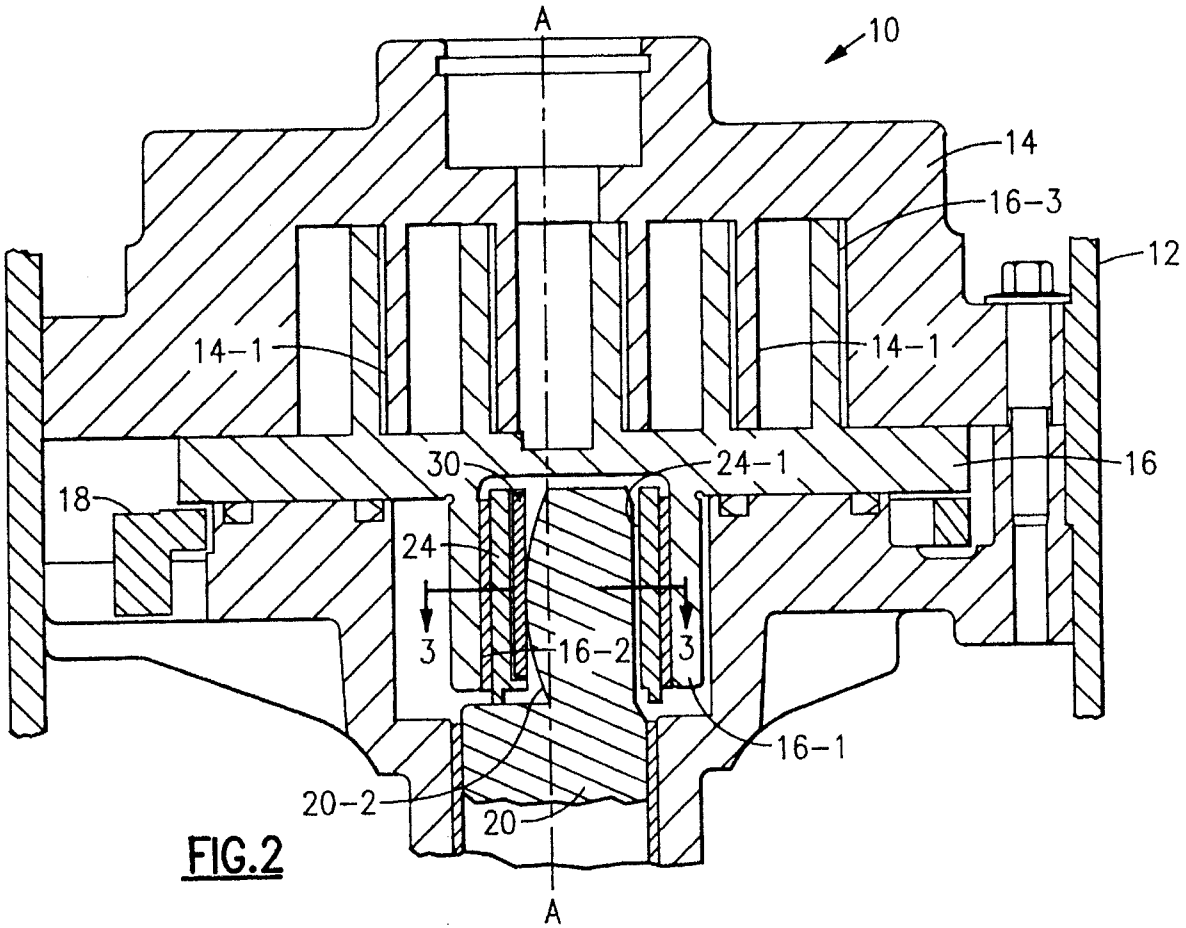
FIG. 2 is a partial vertical sectional view of a scroll compressor employing the present invention taken along a line corresponding to 2—2 of FIG. 3.
Figure 4:
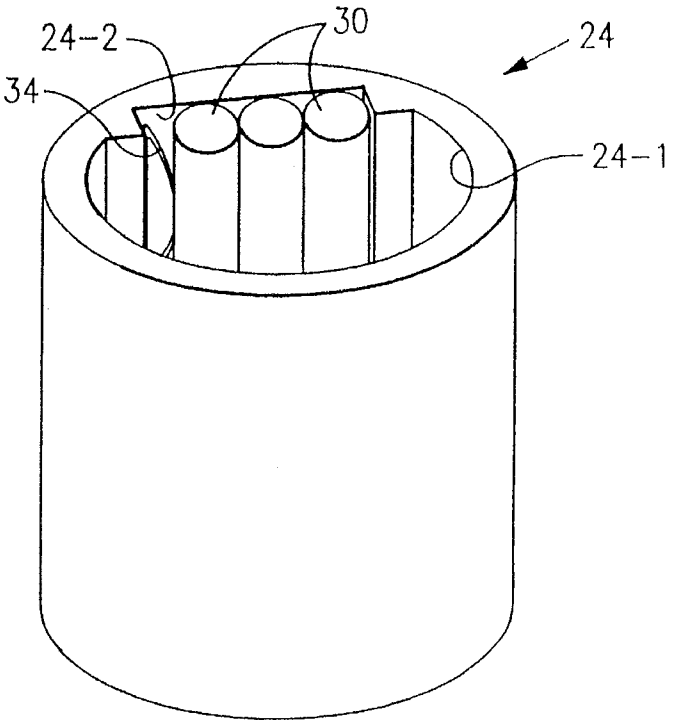
FIG. 4 is a pictorial view of the slider block and rolling element bearings of FIGS. 2 and 3.

In FIG. 2, the numeral 10 generally designates a hermetic scroll compressor having a shell 12. Fixed scroll 14 and orbiting scroll 16 are located within shell 12 and coact to compress gas, as is conventional. Orbiting scroll 16 has an axially extending hub 16-1 having a bore 16-2. As best shown in FIG. 3, slider block 24 is located in bore 16-2 and has a bore 24-1 therein which has a recess 24-2 which receives a plurality of cylindrical rolling element bearings 30. As best shown in FIG. 4, bearings 30 are biased towards one end of recess 24-2 by spring 34. Crankshaft 20 is driven by a motor (not illustrated) and axially extending, eccentrically located drive pin 20-1 is received in bore 24-1 with a clearance such that slider block 24 and bearings 30 carried thereby are able to move relative to drive pin 20-1 in a direction parallel to a plane defined by the axes represented by A and B in FIG. 3. Curved portion 20-2 of drive pin 20-1 defines a surface in line contact with bearings 30. Curved portion 20-2 has a center of curvature which is transverse to the axis of crankshaft 20 and parallel to the plane of the bearings 30.

Figure 11:
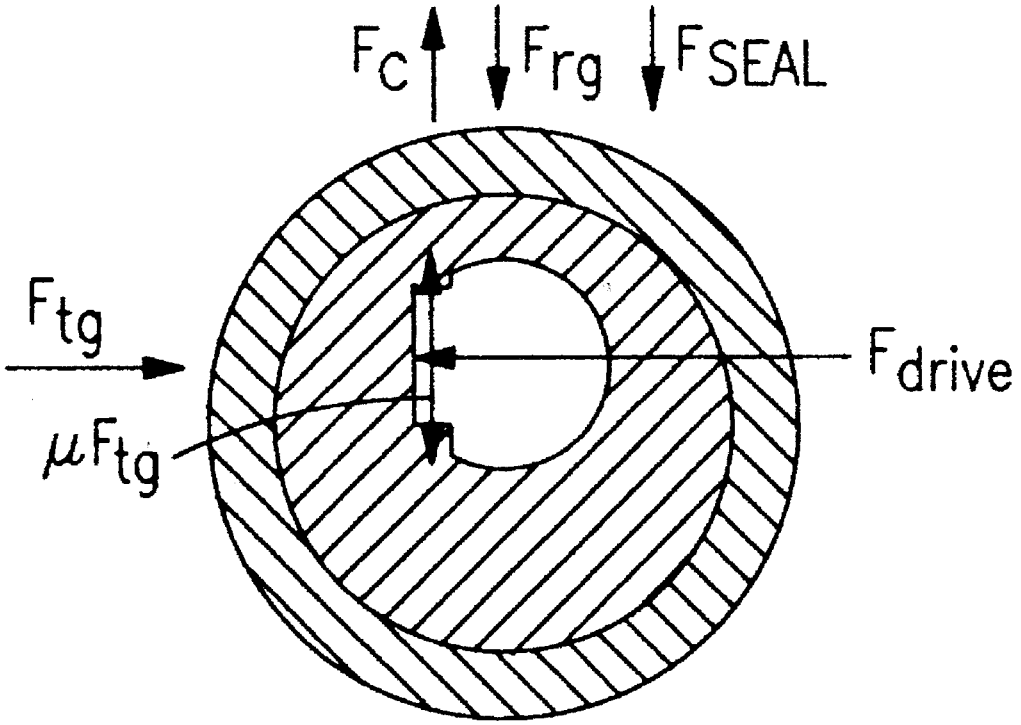
FIG. 11 corresponds to FIG. 3, but shows the forces acting between the driving and driven members.

When compressor 10 is being operated, the motor (not illustrated) causes crankshaft 20 to rotate about its axis, which appears as point B in FIGS. 1 and 3, together with eccentrically located drive pin 20-1. Drive pin 20-1 has an axis A—A which appears as point A in FIGS. 1 and 3. Thus, rotation of crankshaft 20 about its axis causes the axis A—A of drive pin 20-1 to rotate about the point B as shown in FIGS. 1 and 3 and producing a driving force, $F_{drive}$, acting on slider block 24 as shown in FIG. 11. The distance between points A and B represents the radius of orbit of orbiting scroll 16. Since drive pin 20-1 is located in and nominally coaxial with bore 24-1 in the operative position, rotation of drive pin 20-1, acting with force, $F_{drive}$, through bearings 30, causes slider block 24 to rotate therewith about the axis of crankshaft 20 as represented by point B. The driving force, $F_{drive}$, is opposed by the tangential gas forces, $F_{tg}$. Slider block 24 is located in and is coaxial with bore 16-2 and causes orbiting scroll 16 to orbit, rather than rotate therewith, due to the coaction of Oldham coupling 18 with orbiting scroll 16. Thus, there is relative rotary movement of slider block 24 with respect to orbiting scroll 16. With the compressor 10 operating as described, gases are compressed by the coaction of the fixed and orbiting scrolls which is accompanied by the compressed gas acting on the fixed and orbiting scrolls and tending to cause their radial and axial separation. The radial separation forces, $F_{rg}$, are transmitted via hub 16-1 to slider block 24. The radial gas separation forces are opposed by the centrifugal forces, $F_c$, being exerted on the orbiting scroll 16 through drive pin 20-1. Ignoring friction, the difference between $F_{rg}$ and $F_c$ is $F_{seal}$, the sealing force.

FIG. 3 shows drive pin 20-1 contacting bore 24-1 of slider block 24 at the 12 o'clock position and represents a position where the flanks of the wraps 14-1 and 16-3 would be separated as illustrated in FIG. 2. However, when the centrifugal forces, $F_c$, are greater than the radial gas forces, $F_{rg}$ , the slider block 24 and orbiting scroll 16 would move relative to their position illustrated in FIG. 3 such that drive pin 20-1 is nominally coaxial with bore 24-1. They would remain in that position relative to A and B so long as the centrifugal force, $F_c$, was sufficient to overcome the radial gas forces. Because driving surface 20-2 of pin 20-1 is coupled to the driven slider block 24 through rolling element bearings 30 there is very little static or boundary lubrication friction $\mu F_{tg}$, where $\mu$ is the coefficient of rolling friction, assisting the centrifugal force, $F_c$, in opposing flank separation by the radial gas forces. As a result, the presence of bearings 30 cause flank separation between wraps 14-1 and 16-3 to occur at a higher centrifugal force, $F_c$, and earlier/at a higher speed in the shutdown process thereby permitting a greater degree of pressure equalization before the rotation of crankshaft 20 stops and is subject to reverse rotation in the presence of sufficient force available as the pressure differential across compressor 10.

Figure 6:
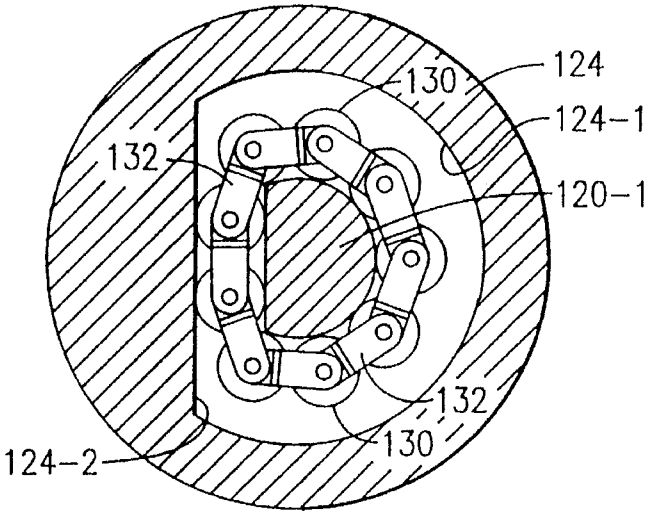
FIG. 6 is a sectional view taken along line 6—6 of FIG. 5.
Figure 5:
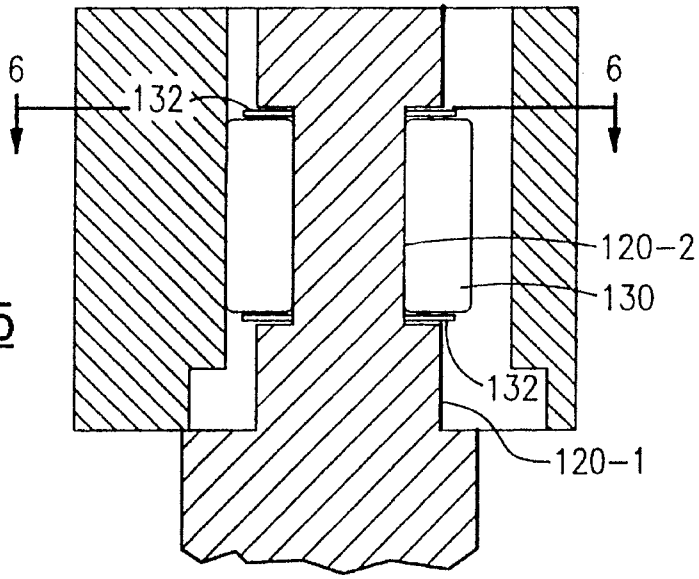
FIG. 5 is a vertical sectional view through a modified drive pin and slider block.

FIGS. 5 and 6 show a modified embodiment in which the bearings are carried by and surround the drive pin. Modified drive pin 120-1 has an annular recess 120-2 which receives a plurality of cylindrical rolling element bearings 130 which are held in an annular relationship by a series of links 132 in the nature of a chain. Bearings 130 are located between pin 120-1 and bore 124-1 and coact with surface 124-2 of slider block 124. Other than having the bearing 130 carried by the drive pin 120-1 the coaction of the parts is the same and permits separation of the flanks of the scroll wraps at a higher centrifugal force because of the reduced frictional assistance.

Figure 7:
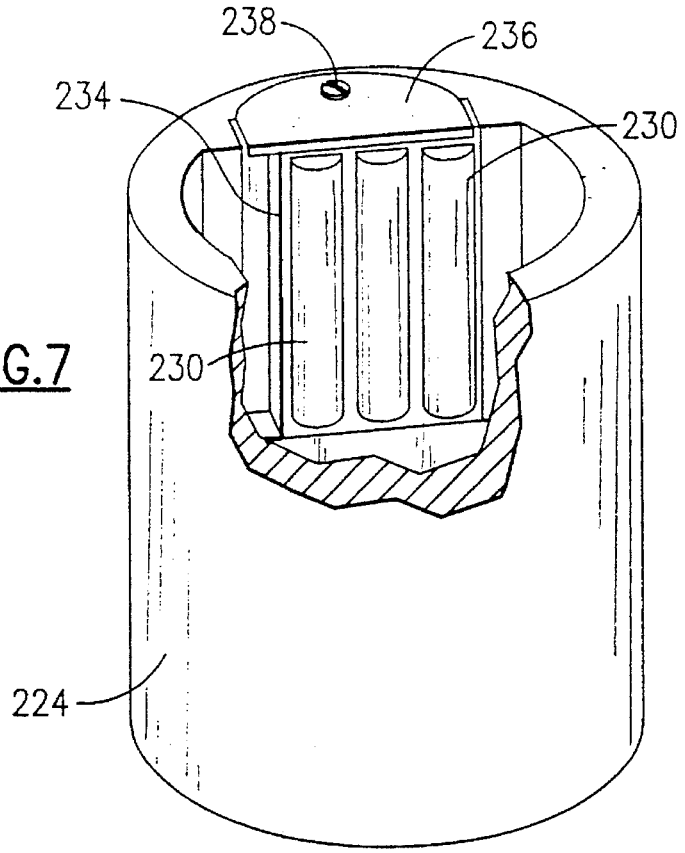
FIG. 7 is partially cutaway pictorial view of a second modified slider block and rolling element bearings.

FIG. 7 illustrates a modified slider block 224 similar to that of FIGS. 2–4 except that cylindrical rolling element bearings 230 are carried in cage 234. Cage 234 is held in place by plate 236 via screw 238. Plate 236 only prevents the rollers 230 and cage 234 from falling out of the slider block 224 and does not inhibit lateral movement of the rollers 230 and cage 234. The operation of the embodiment of FIG. 7 would be the same as that of FIGS. 2–4 except for the bearings 230 being held by the cage 234.

Figure 8:
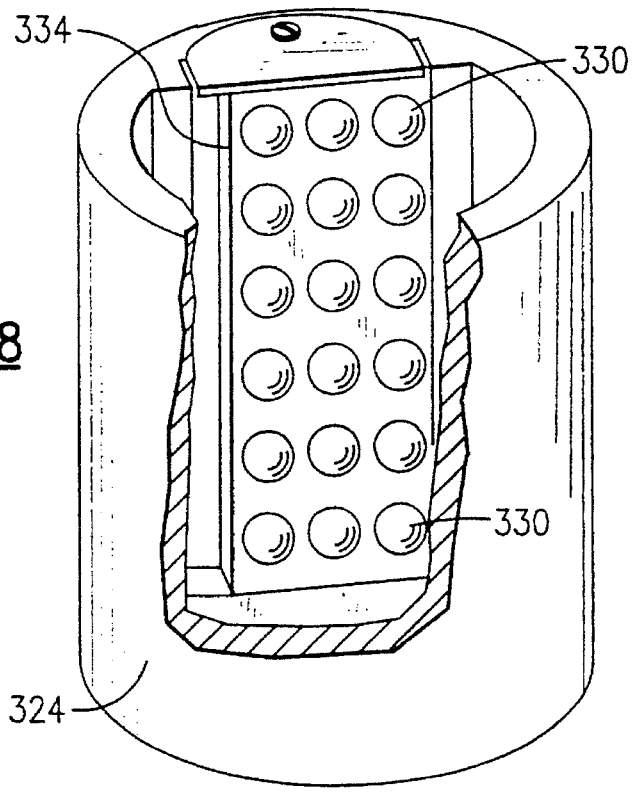
FIG. 8 is a partially cutaway pictorial view of a third modified slider block and rolling element bearings.

FIG. 8 illustrates another modified slider block 324 similar to that of FIG. 7 except that a plurality of ball or spherical rolling element bearings 330, rather than cylindrical rolling element bearings, are carried by cage 334. Except for the different bearings the FIG. 8 device would operate like that of FIG. 7.

Figure 9:
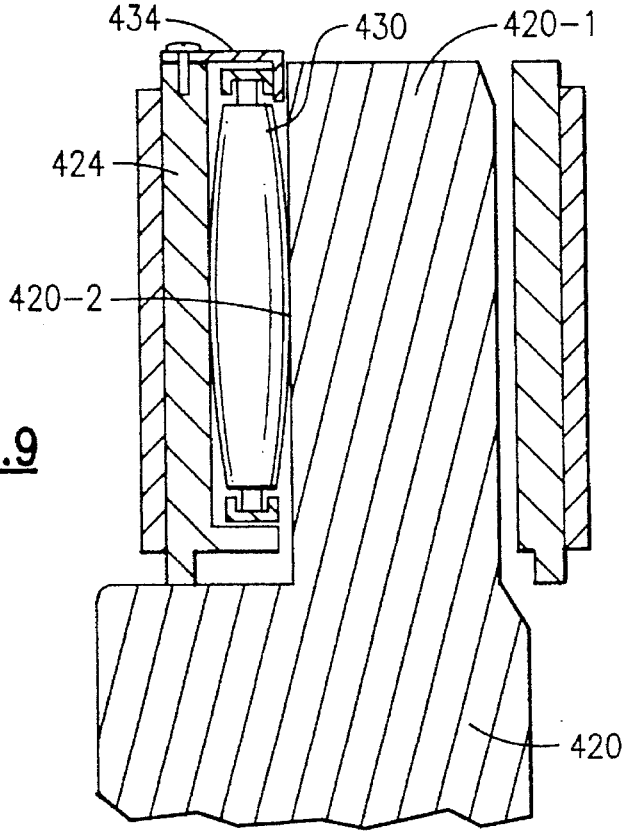
FIG. 9 is a vertical sectional view of a fourth modified slider block and rolling element bearings.

FIG. 9 illustrates another modified slider block 424 and it is similar to that of FIG. 7 except for the use of barrelled rather than cylindrical rolling element bearings. Drive pin 420-1 of shaft 420 has a flat surface 420-2 which coacts with bearings 430. Barrelled bearings 430 are carried in cage 434 and provide the advantage of the coaction of a curved and flat surface which is shown reversed in FIG. 2 and which accommodates flexure of the shaft 420 and/or pin 420-1.

Figure 10:
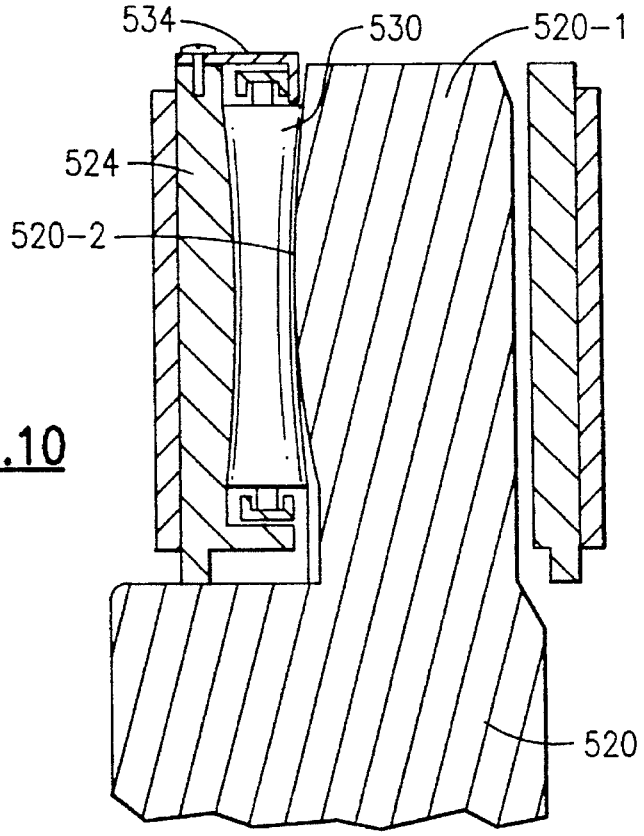
FIG. 10 is a vertical sectional view of a fifth modified slider block and rolling element bearings.

FIG. 10 illustrates the reverse of the FIG. 9 embodiment in that it shows the use of a concave or hour glass shaped rolling element bearings 530 carried in slider block 524 by cage 534. Drive pin 520-1 of crankshaft 520 has a curved portion 520-2 which is received in the complementary curved portion of bearings 530. This embodiment gives a greater area of contact between bearing 530 and curved surface 520-2 of pin 520-1 over a range of flexure of crankshaft 520 and pin 520-1.

In the foregoing discussion the coaction of the members has been described as being a line contact. Hertzian compressive stresses will tend to flatten out curved surfaces so that in reality the line contact becomes "band contact" with the width of the band dependent upon the degree of flattening.

Although preferred embodiments of the present invention have been illustrated and described, other changes will occur to those skilled in the art. For example, the height of the bearings may be adjusted to accommodate the degree and location of contact since the curved pin and/or the barreled bearing have a relatively localized contact. It is therefore intended that the scope of the present invention is to be limited only by the scope of the appended claims.

What is claimed is:

1. A crankshaft drive comprising:

driven means having an axially extending opening therein;

a crankshaft having an axis;

axially extending drive means integral with said crankshaft and having an axis eccentrically located with respect to said axis of said crankshaft;

said drive means being located in said opening of said driven means for rotatably driving said driven means;

beating means in said opening permitting relative movement between said driving and driven means;

said bearing means including a plurality of bearing elements located in said opening between said drive means and said driven means and movable with respect to both said drive means and said driven means whereby when said drive means coacts with said driven means through said bearing means, said drive means and said driven means rotate as a unit and there is a substantial reduction in resistance to relative movement between said drive means and said driven means.

2. The drive of claim 1 wherein said bearing means are rolling element bearings.

3. The drive of claim 1 wherein one of said drive means and bearing means has an axially curved surface.

4. The drive of claim 3 wherein said axially curved surface engages a corresponding surface on the other one of said drive means and bearing means.

5. The drive of claim 1 wherein said axis of said crankshaft and said axis of said drive means define a plane and one of said drive means and bearing means has an axially curved surface and the other one of said drive means and bearing has a flat surface parallel to said plane.

6. The drive of claim 5 wherein said axially curved surface engages said corresponding surface at an essentially constant axial location even when said drive means is deformed under load.

7. The drive of claim 6 wherein said essentially constant axial location is at a midpoint of said axially extending drive means.

8. The drive of claim 1 wherein said driven means includes a slider block and an orbiting scroll of a scroll compressor.

9. The drive of claim 1 wherein the bearing means are supported by said drive means.

10. The drive of claim 1 wherein the bearing means are supported by said driven means.

11. In a scroll compressor having a first and second scroll, a crankshaft drive comprising:

driven means coacting with and driving said first scroll and having an axially extending opening therein;

a crankshaft having an axis;

axially extending drive means integral with said crankshaft and having an axis eccentrically located with respect to said axis of said crankshaft;

said drive means being located in said opening of said driven means for rotatably driving said driven means;

bearing means in said opening permitting relative movement between said driving and driven means;

said bearing means including a plurality of bearing elements located in said opening between said drive means and said driven means and movable with respect to both said drive means and said driven means whereby when said crankshaft rotates, said drive means coacts with said driven means through said bearing means and said drive means and said driven means rotate as a unit, said driven means drives said first scroll with respect to said second scroll and said movement of said crankshaft results in centrifugal force tending to move said driven means and said first scroll radially outward with respect to said axis of said crankshaft such that said first scroll coacts with said second scroll to compress gas which results in gas forces acting on said first and second scrolls with said bearing means providing a substantial reduction in resistance to relative movement between said drive means and said driven means to facilitate movement of said first scroll into contact with said second scroll when centrifugal force exceeds gas forces plus frictional forces between said driven means and said beating means, and out of contact when gas forces exceed centrifugal forces plus frictional forces between said driven means and said bearing means.

12. The drive of claim 11 wherein said bearing means are rolling element bearings.

13. The drive of claim 11 wherein one of said drive means and bearing means has an axially curved surface.

14. The drive of claim 13 wherein said axially curved surface engages a corresponding surface on the other one of said drive means and bearing means.

15. The drive of claim 11 wherein said axis of said crankshaft and said axis of said drive means define a plane and one of said drive means and bearing means has an axially curved surface and the other one of said drive means and bearing means has a flat surface parallel to said plane.

16. The drive of claim 15 wherein said axially curved surface engages said corresponding surface at an essentially constant axial location even when said drive means is deformed under load.

17. The drive of claim 16 wherein said essentially constant axial location is at a midpoint of said axially extending drive means.

18. The drive of claim 11 wherein said driven means includes a slider block and an orbiting scroll of a scroll compressor.

19. The drive of claim 11 wherein the bearing means are supported by said drive means.

20. The drive of claim 11 wherein the bearing means are supported by said driven means.

* * * * *

UNITED STATES PATENT AND TRADEMARK OFFICE

CERTIFICATE OF CORRECTION

PATENT NO. : 5,496,158

DATED : March 5, 1996

INVENTOR(S) : Thomas R. Barito, et al.

It is certified that error appears in the above-indentified patent and that said Letters Patent is hereby corrected as shown below:

Col. 3, line 34, after "gas forces" insert --$f_{rg}$--.

Col. 3, line 39, after "gas forces" insert --$f_{rg}$--.

Signed and Sealed this

Nineteenth Day of November, 1996

*Attest:*

*Attesting Officer*

BRUCE LEHMAN

*Commissioner of Patents and Trademarks*